US007775409B2

(12) United States Patent
Scheindel

(10) Patent No.: US 7,775,409 B2
(45) Date of Patent: Aug. 17, 2010

(54) VALVE FOR A PRESSURIZED DISPENSING CONTAINER

(76) Inventor: Christian T. Scheindel, 2065 Ridge Rd., Randolph Center, VT (US) 05061

( * ) Notice: Subject to any disclaimer, the term of this patent is extended or adjusted under 35 U.S.C. 154(b) by 439 days.

(21) Appl. No.: 11/842,632

(22) Filed: Aug. 21, 2007

(65) Prior Publication Data

US 2008/0041887 A1 Feb. 21, 2008

Related U.S. Application Data

(63) Continuation-in-part of application No. 11/334,716, filed on Jan. 18, 2006, now abandoned, which is a continuation-in-part of application No. 10/882,625, filed on Jun. 30, 2004, now abandoned, which is a continuation of application No. 10/816,969, filed on Apr. 2, 2004, now abandoned, which is a continuation of application No. 10/285,238, filed on Oct. 31, 2002, now abandoned.

(51) Int. Cl.
*B65D 83/00* (2006.01)

(52) U.S. Cl. ..... 222/402.24; 222/402.1; 251/354

(58) Field of Classification Search ..... 222/402.1, 222/402.15, 402.24, 402.25, 399, 402.21, 222/402.22; 251/354
See application file for complete search history.

(56) References Cited

U.S. PATENT DOCUMENTS

| | | | | |
|---|---|---|---|---|
| 2,808,806 | A | 10/1957 | Tysinger | |
| 2,914,224 | A | 11/1959 | Michel | |
| 2,957,610 | A | 10/1960 | Michel | |
| 2,965,270 | A | 12/1960 | Soffer, et al. | |
| 2,994,461 | A * | 8/1961 | Michel | 222/153.11 |
| 3,089,625 | A | 5/1963 | Sorber | |
| 3,206,082 | A * | 9/1965 | Green | 222/402.17 |
| 3,415,426 | A | 12/1968 | Klevland | |
| 4,165,825 | A | 8/1979 | Hansen | |
| 4,522,318 | A | 6/1985 | Del Bon | |
| 4,752,020 | A | 6/1988 | Grueter et al. | |
| 4,791,723 | A | 12/1988 | Jacobson | |
| 4,805,813 | A | 2/1989 | Metcoff et al. | |
| 5,040,705 | A | 8/1991 | Snell | |
| 5,070,611 | A | 12/1991 | Derin et al. | |
| 5,450,983 | A | 9/1995 | Stern et al. | |
| 5,785,301 | A | 7/1998 | Scheindel | |
| 5,787,301 | A | 7/1998 | Arakawa et al. | |
| 6,321,951 | B1 | 11/2001 | Fruitin | |
| 6,340,103 | B1 | 1/2002 | Scheindel et al. | |

(Continued)

*Primary Examiner*—Kevin P Shaver
*Assistant Examiner*—Melvin A Cartagena
(74) *Attorney, Agent, or Firm*—Cowan, Liebowitz & Latman, P.C.

(57) ABSTRACT

An axially actuated valve for use in a pressurized container is controlled by a user to dispense the amount of product desired. The valve stem is moved in an up and down direction so that when dispensing, the user can control the amount of the valve openings that are in communication with the material to be dispensed. A resilient sealing grommet provides an interference fit around the lower part of the valve stem from the button up to the top of the valve stem openings. This interference fit effectively closes off the uncovered portion of the valve openings thereby permitting user control of the dispensing rate. The stem has openings partially tapered in the form of an inverted truncated pyramid to further facilitate user control of the dispensing of product.

12 Claims, 7 Drawing Sheets

U.S. PATENT DOCUMENTS 6,425,503 B1 7/2002 Scheindel
6,474,510 B2 11/2002 Fruitin
6,685,064 B2 2/2004 Fruitin
6,820,777 B2 11/2004 Fruitin
6,918,516 B2 7/2005 Fruitin
7,364,055 B2 * 4/2008 Yquel et al. ..... 222/402.21
2004/0256418 A1 12/2004 Scheindel

* cited by examiner

ALL DIMENSIONS ARE IN INCHES

VALVE FOR A PRESSURIZED DISPENSING CONTAINER

REFERENCE TO RELATED APPLICATIONS

This application is a continuation-in-part of Ser. No. 11/334,716 filed Jan. 18, 2006, now abandoned, which in turn is a continuation-in-part of Ser. No. 10/882,625 filed Jun. 30, 2004, now abandoned, which in turn is a continuation of Ser. No. 10/816,969 filed Apr. 2, 2004, now abandoned, which in turn is a continuation of Ser. No. 10/285,238 filed Oct. 31, 2002, now abandoned; the entire disclosures of which are hereby incorporated by reference.

BACKGROUND OF THE INVENTION

This invention relates to a valve design for use in dispensing product from a pressurized container and more particularly to a valve whose design provides user control over the dispensing rate. This is particularly valuable where pressure in the container is developed from a gas, such as pressurized air or pressurized nitrogen, in which the pressure decreases as product is dispensed.

Applicant's U.S. Pat. No. 5,785,301 and U.S. Pat. No. 6,425,503 and U.S. Pat. No. 6,340,103 are representative of prior art valve designs for use in hand held pressurized containers.

The pressure in most of these barrier containers is maintained as product is dispensed by virtue of having the pressure developed through a hydrocarbon type of gas in which a liquid reserve is contained in the pressured gas chamber. As product is dispensed and the pressured gas chamber increases in volume, the liquid will evaporate to maintain a fairly constant pressure.

It is known to use pressurized gas such as pressurized nitrogen. In those cases, as product is dispensed and the gas pressure chamber increases in volume, the pressure therein drops. This drop in pressure reduces the rate at which product is dispensed and is inconvenient for the user.

Accordingly, pressurized dispensing containers employing pressurized air or nitrogen are not generally used.

However, the use of a hydrocarbon causes environmental concerns. Hundreds of millions of these containers are used. When these containers are disposed, they carry the hydrocarbon with which they are initially charged. Eventually this hydrocarbon is released into the environment.

There is great concern to provide a practical and useable pressurized dispensing container in which the pressure is created by a pressurized nitrogen or pressurized air or some other more environmentally acceptable pressurized gas.

It is a major purpose of this invention to provide a pressurized dispensing container adapted to use pressurized nitrogen or gas that is acceptable to the user.

It is a related purpose of this invention to provide such a container in which the user can maintain a substantially consistent dispensing rate of product throughout the use of the container.

It is a related object of this invention to obtain this consistent dispensing rate in a design which maintains the cost of the valve and the discharge mechanism at a level that will be cost effective for the user.

It is a further purpose of this invention that this ability to maintain a substantially constant discharge rate be easily and readily controllable by the user.

It is another purpose of this invention to provide a valve design which is particularly adapted to be used in a vertical fashion; that is, used through axial movement of the valve element.

BRIEF DESCRIPTION

In brief, the embodiment described herein is to a valve having a mounting cup, an axially movable valve element and a resilient sealing grommet surrounding the stem of the valve element. The valve stem has sidewall openings. When the valve is axially depressed, these openings are in communication with the product to be dispensed in the pressurized can on which the valve is mounted. The product, under pressure, is forced through the valve stem openings up through a central passageway in a tubular valve stem and out of whatever dispensing actuator is appropriate for the product being dispensed. In addition to the valve stem with its sidewall openings, there is a button at the base of the valve stem that abuts under pressure against a horizontal surface of the sealing grommet in order to assure sealing of the product when in the closed state.

The sealing grommet has an annular interior surface that surrounds the valve stem and has an interference fit relationship with the lower portion of the valve stem from the button to at least the top of the dispensing openings in the valve stem. This interference fit is required to assure that when the stem is depressed to expose a portion of the openings to product, the result is a partial opening with a less than full dispensing rate.

In barrier containers, using compressed nitrogen or air, as product is dispensed, the pressure decreases. Depressing the valve to expose a portion of the valve stem opening as a function of the loss of pressure enables a relatively satisfactory steady dispensing of product during the course of dispensing product. But for this to work, the grommet has to effectively seal off the unexposed portion of the valve stem opening. The interference fit assures that partial opening result.

This user control is particularly important when the propellant is a compressed gas, such as air or nitrogen; but may be useful in other contexts to provide operator control over the rate at which product is dispensed.

The dispensing openings are elongate in the axial direction.

The embodiment disclosed is particularly adapted for dispensing a highly flowable product such shave gel and also a spray product such as an insecticide spray. In that embodiment, the sealing grommet has a recess in its base for receiving the valve button. The relationship between the button diameter and the grommet recess diameter is a slip fit. The result is that the walls of the recess assure stability of the valve by minimizing any tendency of the valve to tilt.

Recesses in the edge of the button allow product to travel past the button into the valve stem sidewall openings when the valve is open. It is important that the recesses in the button be at least equal in area to the valve stem openings so as to avoid further restriction on the flow of the product to be dispensed.

It is preferable for the valve stem openings to have longitudinal edges that taper outward from a minimum width at the lowest point in the opening to a maximum width at or near the top of the opening. The uppermost segment of the opening could well have straight walls. The result is an opening that is approximately an inverted truncated triangular topped by a rectangular segment.

A boot segment in the upper portion of the grommet engages a shoulder on the valve stem so that when user pressure on the valve is removed the boot will push the valve up into a closed state.

It is important that the top of the boot have an inwardly directed annular flange that snugly engages an annular recess or groove in the valve stem. This assures that the boot does not escape the shoulder under the restoring pressure exerted when the boot is fully collapsed.

Terminology

As used herein, the term "upper" and formatives thereof should be understood to refer to a location closer to the dispensing actuator; that is, the element which is usually actuated with the finger of the user. The terms "lower" and "down" and formatives thereof should be understood to refer to a location closer to the interior of the container on which the valve assembly is mounted. Most containers are stored on their base. The input end of the valve is lower in the container and the output end is at the upper end. Many products are dispensed upside down or laterally. It should be understood herein that the terms "upper" and "lower" are used to indicate relative position or direction in connection with the above convention, not with respect to the position of the container when dispensing product.

The term "valve" is sometimes used in a more inclusive sense and other times in a less inclusive sense. As used herein, the term "valve assembly" will normally be used to refer to the three element combination of the mounting cup, a movable valve element and a sealing grommet. The term "valve" will usually be used to refer to the combination of the movable valve element and the sealing grommet. And, to provide an appropriate distinction, the term "valve element" will be used to refer to the element around which the grommet is mounted and which is depressed in a downward direction relative to the grommet to provide an open state and when released move up relative to the grommet to provide a closed state.

The grommet has as its main function to seal the valve stem openings by sealing pressure between the upper surface of the button and a horizontal surface of the grommet. Thus, it is referred to herein as a sealing grommet. The upper portion of the grommet is referred to as a boot. The boot portion engages a shoulder on the valve stem. The boot is resilient and compresses when the valve is opened. The boot serves to provide a restoring force on the valve element to close the valve when finger pressure on the actuator is released.

There is a "full engagement" relationship between the flange 50 at the top of the boot 44 and the recess 52 in the valve stem 30. In the embodiment disclosed, a 20 mil thick resilient material flange engages a 20 mil thick non-resilient recess. This engagement is referred to herein as a "full engagement" or as "two elements being fully engaged". This relationship will normally be tighter than that which is called a slip fit relationship and thus is also referred to as a "snug" relation. Nominally the two dimensions being engaged are equal. There may be some slight variation depending upon the requirements of assembly and the materials used. The purpose is to provide as snug a fit as possible in order to avoid having the boot 44 slip out of engagement and move over the shoulder 48 when the valve is fully depressed.

The open state of the valve is normally used to refer to both fully open and partially open valve conditions.

A mil is a thousandth of an inch (0.001 inches).

BRIEF DESCRIPTION OF THE DRAWINGS

FIG. 5 shows the top of the button portion of the valve element and the recesses 32 in the edge of the button that allow product to pass through when the valve is fully or partially open.

DESCRIPTION OF THE PREFERRED EMBODIMENTS

Figure 1:
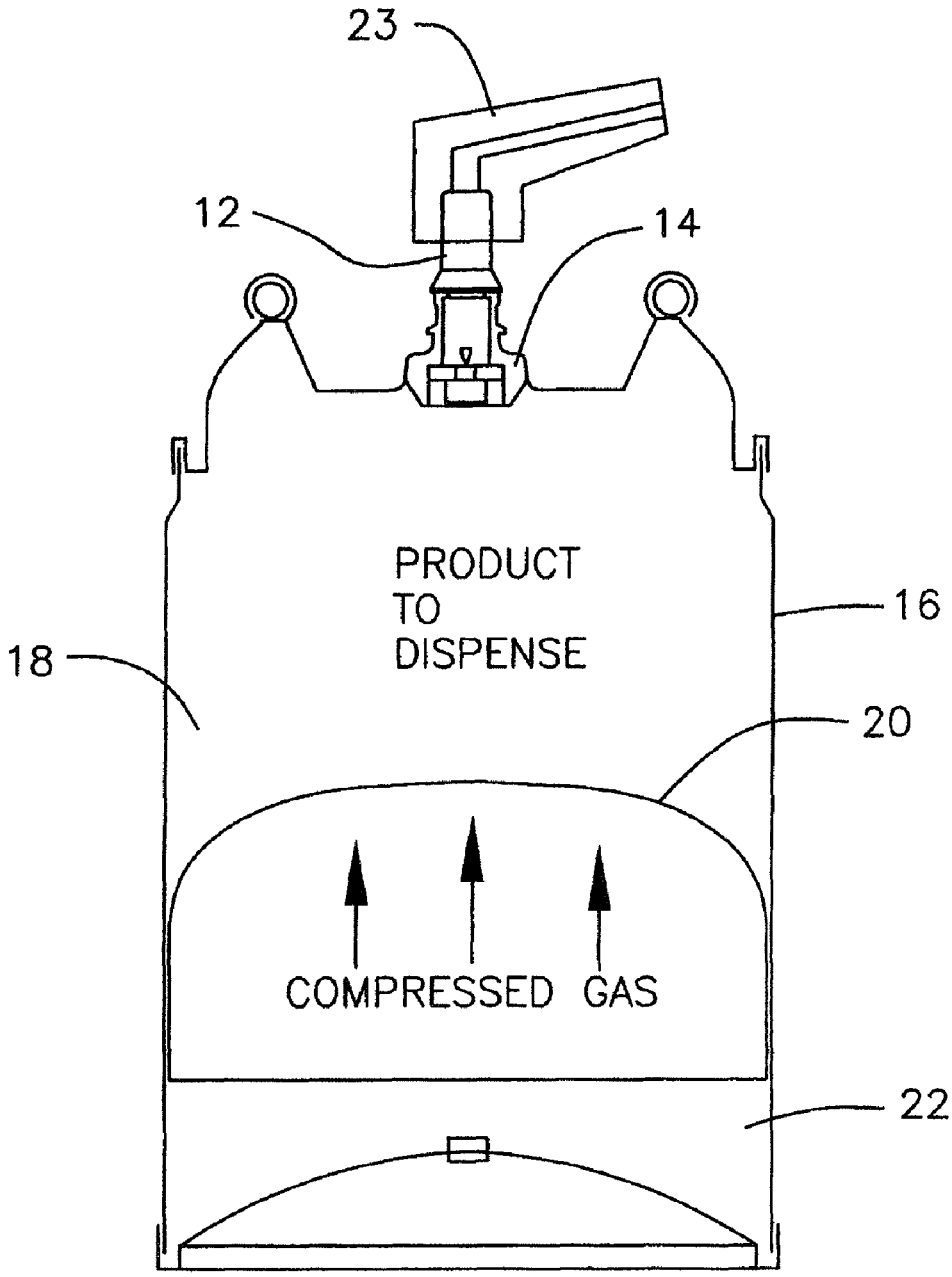
FIG. 1 is a schematic view of a valve 12, 14 of this invention mounted on a pressurized container.
Figure 2:
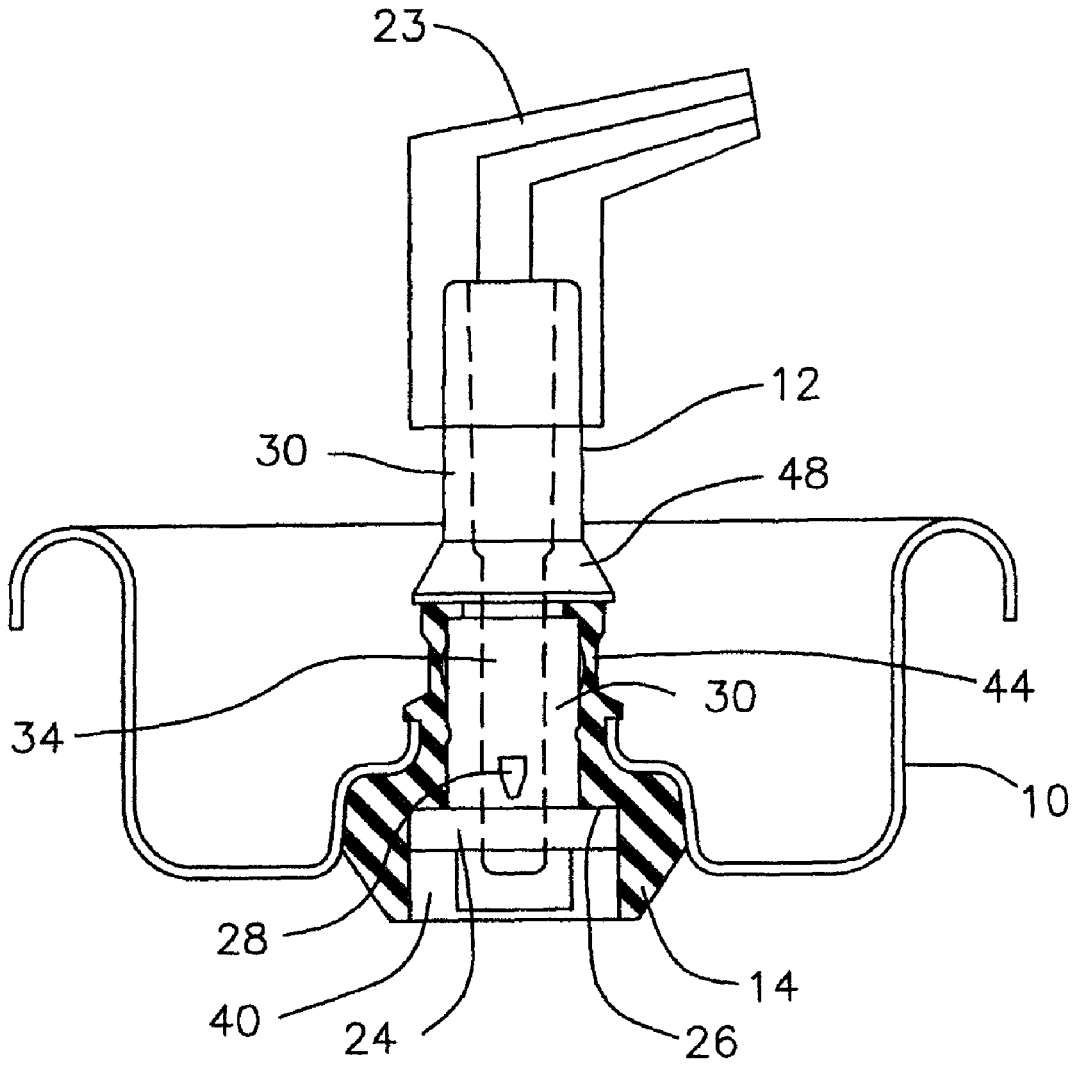
FIG. 2 is a larger scale view of the valve of FIG. 1 in a closed state showing the button 24 of the valve pressed against the horizontal ceiling 26 of the recess 40 in the grommet 14 thereby blocking product from reaching the valve stem openings 28.

The FIGs. illustrate a single embodiment. As shown in FIG. 2, the three piece valve assembly is constituted by a mounting cup 10, a movable valve element 12 and a resilient annular sealing grommet 14. The valve element 12 has a button 24 which fits in a recess 40 in the base of the grommet 14.

The mounting cup 10 performs a known function of mounting the valve assembly on top of the container 16 in which the product to be dispensed is contained. The product 18 to be dispensed is above the piston 20 which acts as a barrier between the product 18 and the gas under pressure in the lower chamber 22. The gas under pressure causes the piston 20 to apply pressure to the product 18. A piston 20 barrier is shown. But as is known in the art a collapsible bag barrier can be employed. A hand operated actuator 23 is mounted on top of the valve element 12.

The valve has a closed state in which the valve element 12 is in an upward position where a button 24 at the base of the valve element 12 abuts against a horizontal surface 26 at the top of the recess 40 in the sealing grommet 14. In this sealed or closed state, the engagement between the button 24 and the grommet surface 26 blocks product from access to the sidewall openings 28 in the valve stem 30. The valve stem 30 has two openings 28 in the embodiment shown.

Figure 4:
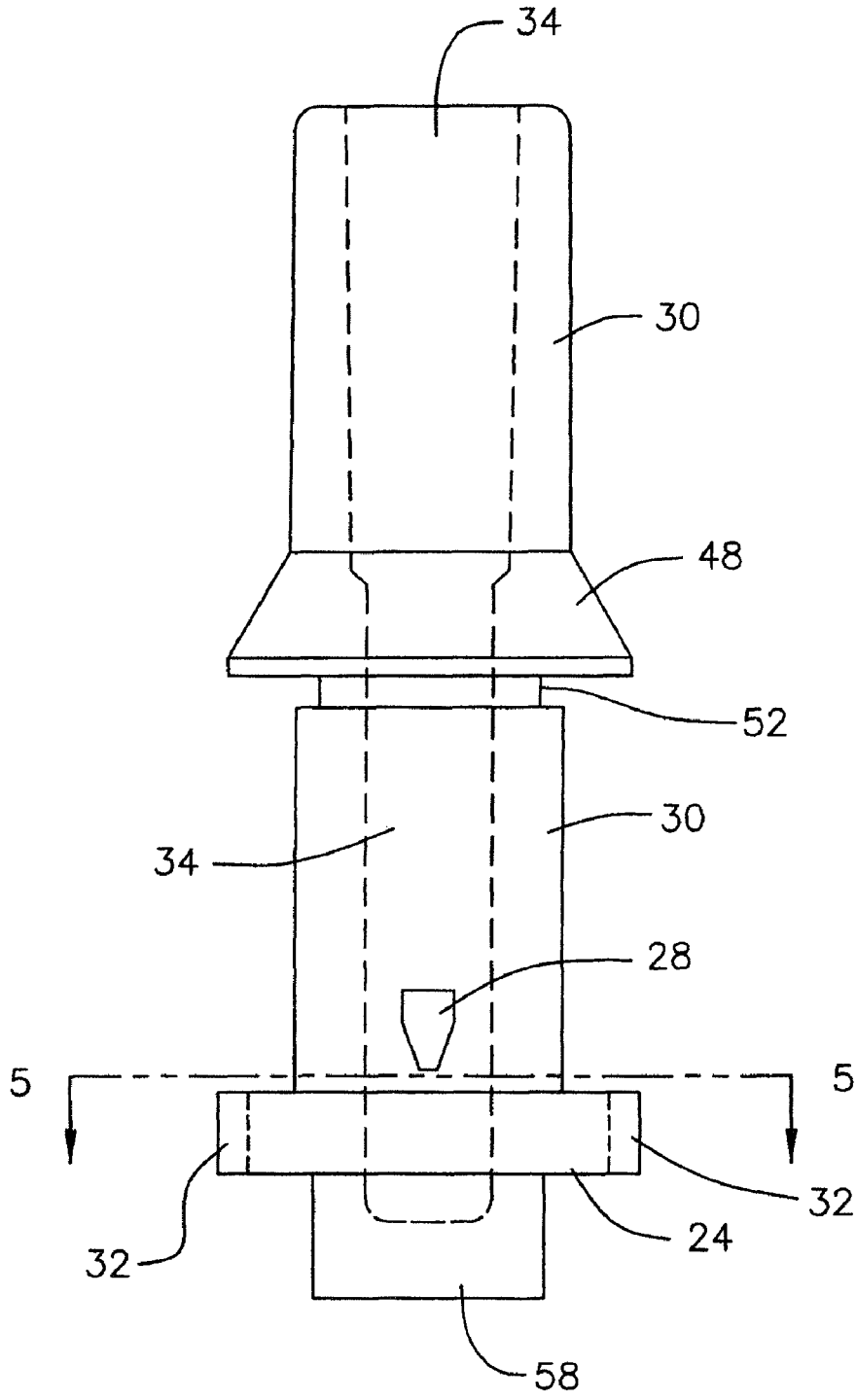
FIG. 4 is an elevational view of the movable valve element 12. The recesses 32 in the button 24 are shown in FIGS. 4 and 5 but are omitted from FIGS. 2 and 3 to simplify presentation
Figure 5:
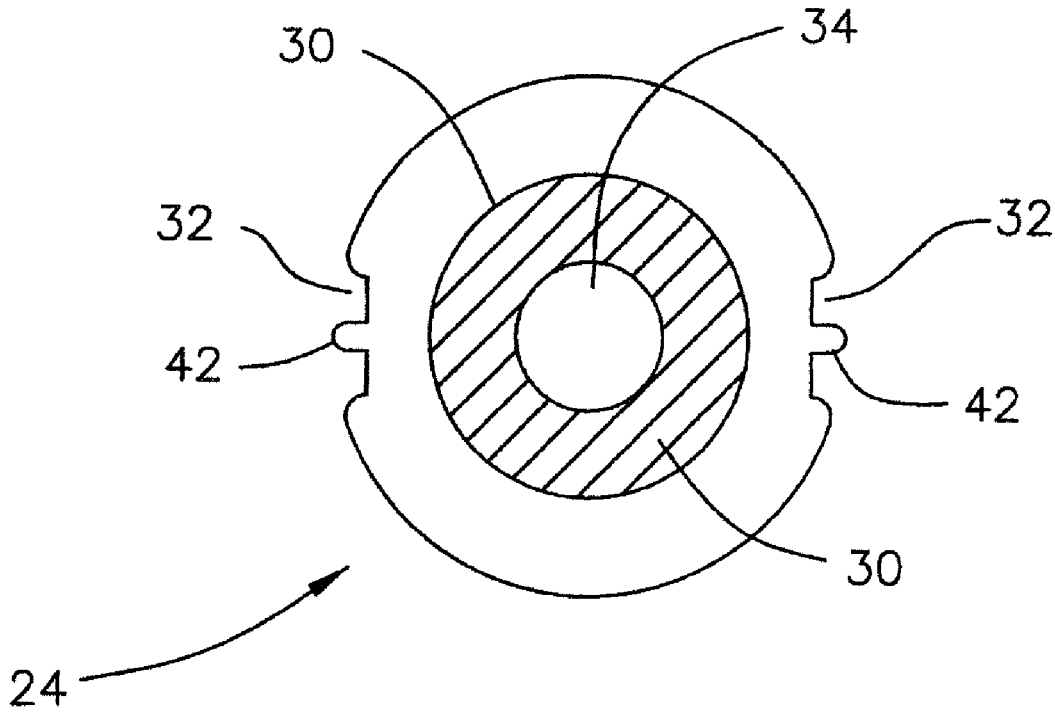
FIG. 5 is a view along the plane 5-5 of FIG. 4.

As shown in FIGS. 4 and 5, the button 24 has two recesses 32 in the edge of the button so as to provide communication between the valve stem openings 28 and the product to be dispensed. These recesses 32 can best be seen in FIG. 5 and are at the edge of the button 24 and extend through the button 24.

Figure 3:
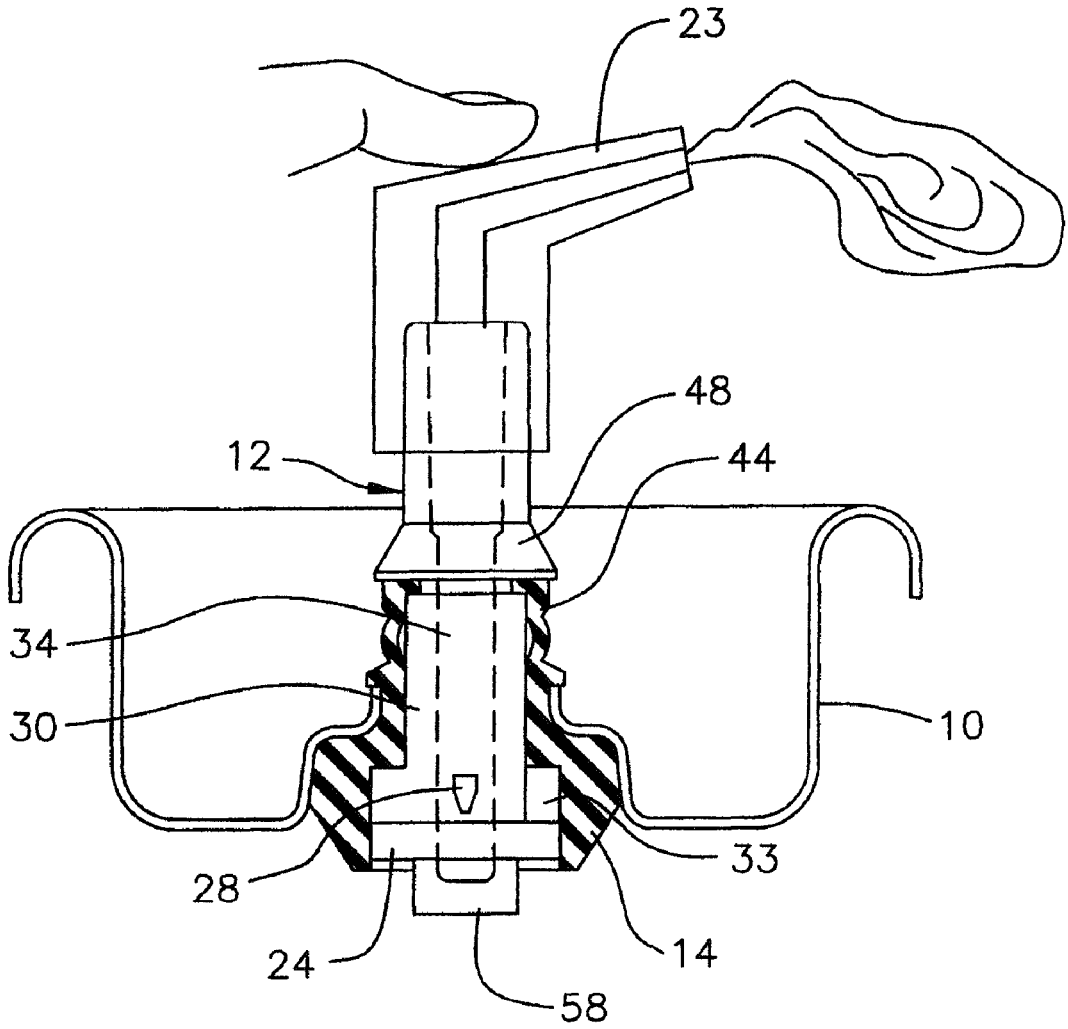
FIG. 3 is a view similar to that of FIG. 2 in which the valve element 12 is fully depressed so that the entire valve stem openings 28 are exposed to the product being dispensed. This is the fully open state.

As shown in FIG. 3, when the valve element 12 is depressed, the button 24 separates from the grommet surface 26. The product under pressure can flow through recesses 32 (see FIG. 5) in the edge of the button 24 through the space 33 between the button 24 and grommet surface 26 and into the valve stem openings 28. The product is then forced through the center bore or passageway 34 in the valve stem 30 to be dispensed from the actuator 23 fitted to the top of the valve stem 30. In the fully open state, the button 24 remains within the grommet recess 40.

Figure 7:
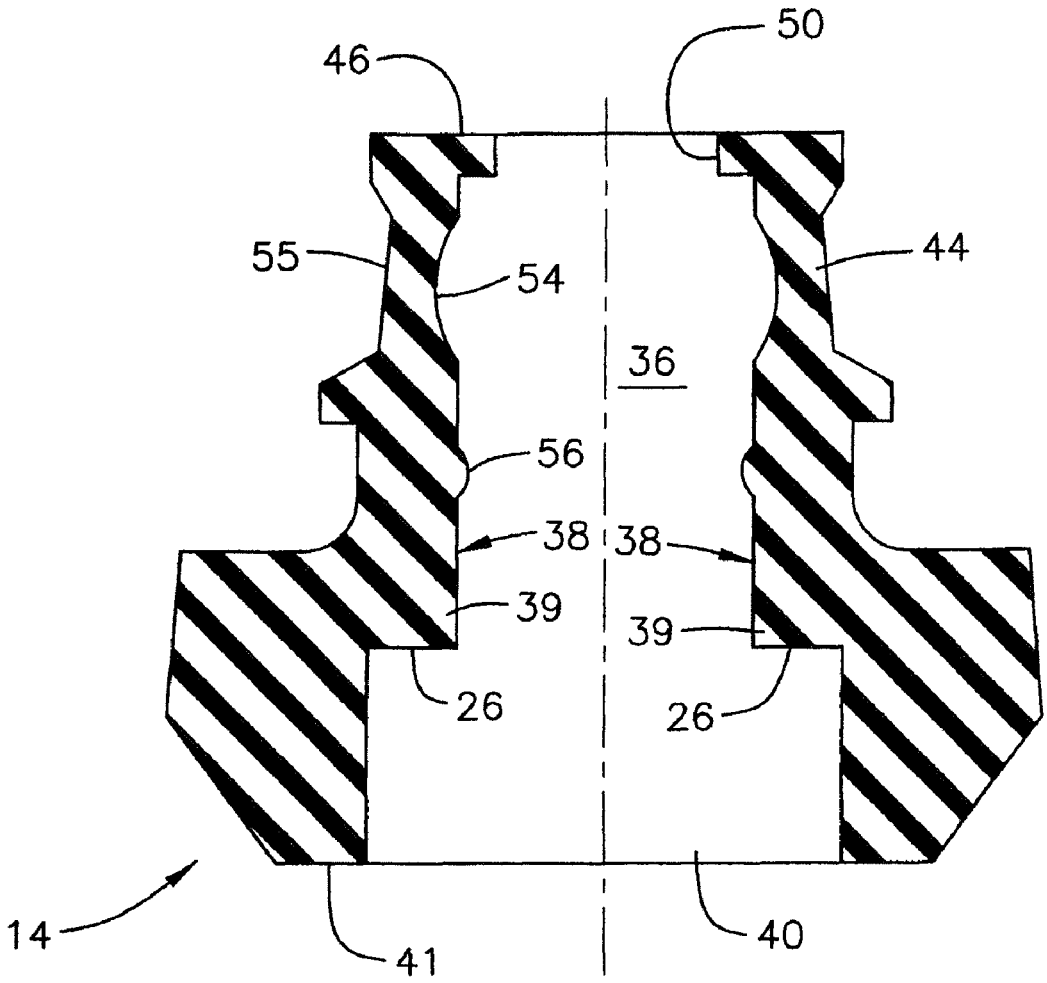
FIG. 7 is a longitudinal section view through the grommet 14 in its relaxed state.

The sealing grommet 14 is a resilient material such as an elastomer or rubber, examples of which are sold under the trademarks Santoprene and Hytrel. As may best be seen in FIG. 7, the annular grommet 14 contains an inner bore 36 having a lower portion 38 which engages the lower portion of the valve stem 30 from the button 24 up to at least the upper end of the valve stem openings 28. This engagement between the grommet bore portion 38 and the valve stem is an interference fit engagement. For example, for a valve stem having a diameter of approximately 150 mils, the diameter of the grommet portion 38 when the grommet is in its unassembled relaxed state might be about 10 mils less. This provides approximately a five mil interference fit on a radius.

The corner 39 of the grommet 14 is an orthogonal intersection between the bore 36 and the horizontal surface 26 of the grommet. This assures that the grommet surface 38 will be flush against the entire lower portion of the valve stem 30.

When the valve is partially open, the interference fit between grommet surface 38 and surface of valve stem 30 is maintained and thus the valve stem openings 28 can be partially opened by the operator to provide selection of the rate at which product is dispensed.

When the valve element 12 is depressed by manual pressure of the user, the valve stem openings 28 are moved partially or wholly out of engagement with the grommet surface 38. This movement can be a partial or a complete disengagement or opening of the openings 28. The user can adjust the rate at which product is dispensed by the amount that the valve element 12 is moved down in an axial direction.

The interference fit relationship between the grommet surface 38 and the zone of the openings 28 is crucial to assure that a partial opening of the valve can be achieved. The interference fit relationship assures that the portion of the valve stem opening 28 that continues to be blocked by the grommet surface 38 will be effectively blocked and will not be opened by pressure of the product being dispensed.

Figure 6:
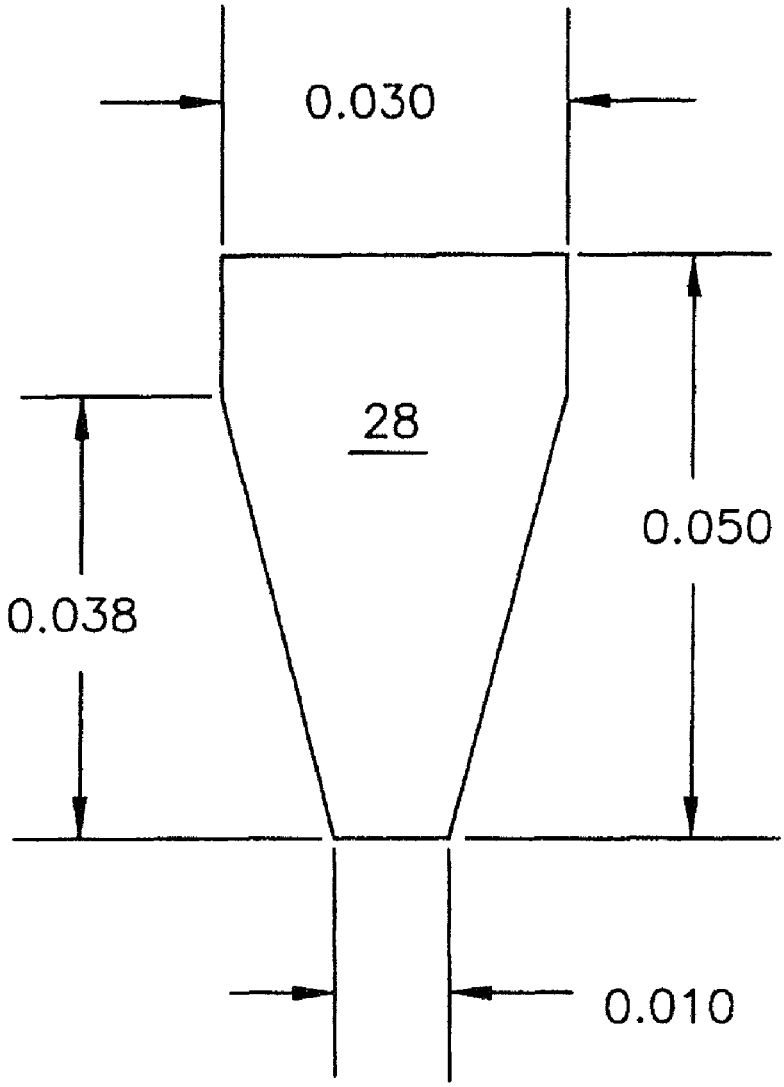
FIG. 6 is a larger scale view of the opening 28 in the valve stem showing the variable width of the opening along its elongate length and providing dimensions in one embodiment.

The shape of openings 28 are shown in detail in FIG. 6. When compressed air or compressed nitrogen is employed, the pressure drops as product is dispensed because the volume of the pressure chamber 22 increases as the volume of the product chamber 18 decreases. Having the dimensions of the opening increase in both directions (axially and transverse thereto) as the valve is depressed provides enhanced comfort and control for the user. The opening 28 geometry shown is a truncated inverted triangle topped by a small rectangular portion. This has been found to be useful; particularly when dispensing a product such as a shave gel.

The grommet 14 has a recess 40 in its base into which the valve button 24 fits. The diameter of the button and the diameter of the recess 40 have a slip fit relationship. For example, a button with a 250 mil diameter and a grommet recess 40 with a 251 mil diameter is representative of the essentially slip fit relationship involved. This recess 40 helps to dimensionally stabilize the valve, minimize any tendency to tilt and thereby assists in providing control over the amount by which the openings 28 are opened and thus control of the rate at which product is dispensed.

The recesses 32 in the button 24 have the configuration shown in FIG. 5 in which a protrusion 42 bifurcates the openings. This is in one preferred embodiment in order to facilitate automatic assembly. It is important, though, that the cross sectional area of the two recesses 32 openings be at least equal to the area of the two valve stem openings 28 if it is desired to avoid any additional restriction on the flow of product.

This resilient sealing grommet 14 has an upper boot portion 44. The upper surface 46 of the boot 44 engages a shoulder 48 in the valve stem 30 to provide a force to assure that the valve returns to a closed state when pressure is removed from the actuator attached to the valve. An inwardly extending annular flange 50 at the top of the boot 44 engages an annular recess 52 in the valve stem 30 so as to assure that the grommet 14 will remain properly positioned relative to the valve element 12 during the opening and closing operation of the valve.

It is important that the thickness of the flange 50 and the width of the recess 52 have a snug relationship. In one embodiment, they are both about twenty mils. The upper end of the boot 44 is beefed up by extending it radially outward under the shoulder 48. The full engagement of flange 50 and recess 52 together with the increased diameter of the shoulder 48 and thus increased material at the top of the boot assures that when the valve element is depressed, the boot 44 will not move up on the valve stem, over the shoulder 48. The stability of boot top and shoulder 48 face assures that the boot 44 will appropriately compress so that the force required for returning valve 12, 14 to its closed state will be available when operator pressure is removed from the actuator 23.

The boot 44 has a concave inner surface 54 which assures that the boot 44 will buckle out when vertical pressure is applied when the valve 12 is moved downward and thus avoid having the boot significantly resist opening of the valve. A vertical slit (not shown) in the boot 44 might be useful to ease actuation. That will depend on grommet material and boot size. The outer surface 55 of the boot wall is radially recessed from the top outer edge of the boot so that the boot wall will resist opening only enough to assure that the boot wall on compression will provide the force needed to close the valve when operator pressure is removed.

An annular bump 56 on the bore of the grommet 14 can be of value to prevent product from leaking up between the valve stem and grommet when the valve is in its fully or partially open state.

The lower stem extension 58 is to facilitate handling in assembly. The bore 34 extends below the openings 28 to reduce the amount of plastic used in molding and to facilitate cooling after molding.

One Example of the Embodiment Disclosed

In one example of this embodiment, a product useful for dispensing gel shave has the following dimensions. For clarity and ease of presentation, the FIGs. are not proportional to the following typical dimensions.

Grommet Recess 40: 251 mils in diameter and 115 mils deep.

Button 24: 250 mils in diameter and 50 mils thick.

Valve Stem 30: 152 mils in diameter.

Grommet inner diameter at the lower portion 38: 142 mils in relaxed state.

Center Passageway 34: in valve stem 700 mils (this passageway is slightly tapered in order to permit removal from the mold) and thus does not have a completely uniform diameter).

Shoulder 46 Diameter: 230 mils.

Valve Stem Openings 28: See FIG. 6 for dimensions.

Boot Flange 50: 20 mils thick by 20 mils long.

Stem Recess 52: 20 mils thick by 20 mils deep.

A preferred embodiment has been described. However, it is apparent to those skilled in the art that certain changes can be made without departing from the teachings of the invention and the scope of the claims.

Most particularly, the dimensions and tolerances will be a function of the product being dispensed and most particularly viscosity of the product being dispensed, the normal desired rate at which product is dispensed and the nature of the dispensed material (that is, whether what is being dispensed is a spray or a true aerosol or liquid flow).

The dimensions of the sidewall openings in this valve stem and the optimum amount of the interference fit between the resilient grommet and the zone of the stem where the sidewall openings exist may vary somewhat as a function of such factors as the viscosity of material being dispensed and the pressure at which product is dispensed.

The recesses 40 along the edges of the button 24 could be replaced by openings through the button. But the small dimension of button and openings make recesses easier to mold.

What is claimed is:

1. A vertically movable valve for use in a pressurized dispensing container, the valve having a closed state and a range of dispensing states, the valve including a valve member having a stem with an axis, at least one dispensing opening at a lower zone of the stem, and a button at the lower end of the stem, the valve also having a resilient annular sealing grommet around the stem, comprising:

an annular interference fit zone between the resilient grommet and the lower portion of the valve stem, said zone extending across the said valve stem wall dispensing opening when in the closed state, a recess in the base of said grommet to accept the button of the stem, said recess being deep enough so that said button is within said recess when the valve is in a fully opened state, said edge of said button and the annular wall of said recess having a slip fit relationship, at least one recess in the edge of the button to provide product passageway when the valve is opened, and the at least one dispensing opening of the stem has an elongate shape, elongated in the direction of the axis of the stem.

2. The valve of claim 1 wherein: said elongate dispensing opening has a variable transverse opening distance, said transverse distance being greater at the upper portion of the opening and lesser at the lower portion of the opening.

3. The valve of claim 1 wherein: said dispensing opening is substantially an inverse truncated triangle extending down from a rectangular zone.

4. The valve of claim 1 wherein: said interference zone extends down to the button.

5. The valve of claim 1 wherein: said interference zone extends down to the button.

6. The valve of claim 5 wherein: the area of said recesses in the edge of the button substantially equals the area of said elongate stem wall openings.

7. The valve of claim 1 wherein: the area of said recesses in the edge of the button substantially equals the area of said elongate stem wall openings.

8. The valve of claim 1 wherein: the area of said recesses in the edge of the button substantially equals the area of said elongate stem wall openings.

9. The valve of claim 1 further comprising:

a shoulder on the valve stem, said shoulder having a downward facing surface, an annular boot portion of said grommet, said boot having an upper surface that engages said downward facing surface of said shoulder, an upper portion of said boot including a radially inwardly extending annular flange, the upper surface of said flange and the upper surface of said boot providing an extended upward facing surface, and an annular recess on said stem, said recess being adjacent to and below said shoulder, said recess having an upper surface and a lower surface, said upper surface of said recess and said downwardly facing surface of said shoulder providing an extended downwardly facing surface across said shoulder and said recess, said boot below said flange and said stem below said recess having a snug fit to provide full insertion of said flange into said recess, and said extended upwardly facing surface of said boot and said flange and said extended downwardly facing surface of said recess and shoulder engaging to provide a restoring force when said valve is depressed, wherein said boot and said flange provide a combined hoop strength to prevent the boot from snapping over said flange.

10. The valve of claim 9 wherein: the at least one dispensing opening of the stem has an elongate shape, elongate in the direction of the axis of the stem.

11. The valve of claim 10 wherein: said interference zone extends down to the button.

12. The valve of claim 11 wherein: the area of said at least one recess in the edge of the button substantially equals the area of said elongate stem wall openings.

* * * * *